US009057270B2

(12) United States Patent
Strawn et al.

(10) Patent No.: US 9,057,270 B2
(45) Date of Patent: Jun. 16, 2015

(54) COMPRESSOR INCLUDING SUCTION BAFFLE

(71) Applicant: Emerson Climate Technologies, Inc., Sidney, OH (US)

(72) Inventors: Bradley Strawn, Wapakoneta, OH (US); Kyle M. Bergman, Yorkshire, OH (US); Keith Brown, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 154 days.

(21) Appl. No.: 13/930,834

(22) Filed: Jun. 28, 2013

(65) Prior Publication Data

US 2014/0017106 A1 Jan. 16, 2014

Related U.S. Application Data

(60) Provisional application No. 61/669,793, filed on Jul. 10, 2012.

(51) Int. Cl.

| | |
|---|---|
| ***F04C 29/12*** | (2006.01) |
| ***F04C 18/02*** | (2006.01) |
| ***F04C 29/02*** | (2006.01) |
| ***F01C 21/00*** | (2006.01) |
| ***F04C 23/00*** | (2006.01) |

(52) U.S. Cl.

CPC ..... *F01C 21/007* (2013.01); *Y10T 29/4924* (2015.01); *F04C 23/008* (2013.01); *F04C 29/026* (2013.01); *F04C 29/12* (2013.01); *F04C 18/0215* (2013.01)

(58) Field of Classification Search

CPC ..... F01C 21/007
USPC ..... 418/55.1
See application file for complete search history.

(56) References Cited

U.S. PATENT DOCUMENTS

| | | | | |
|---|---|---|---|---|
| 5,055,010 | A | 10/1991 | Logan | |
| 6,402,485 | B2 * | 6/2002 | Hong et al. | 417/366 |
| 7,311,501 | B2 * | 12/2007 | Wehrenberg et al. | 418/55.1 |
| 7,503,755 | B2 * | 3/2009 | Lai et al. | 417/292 |
| 8,133,043 | B2 * | 3/2012 | Duppert | 418/55.1 |
| 8,152,503 | B2 * | 4/2012 | Haller | 418/55.1 |

* cited by examiner

*Primary Examiner* — Mary A Davis
(74) *Attorney, Agent, or Firm* — Harness, Dickey & Pierce, P.L.C.

(57) ABSTRACT

A compressor includes a shell, a bearing housing, a compression mechanism and a suction baffle. The shell defines a suction pressure region and a suction gas inlet. The bearing housing is fixed relative to the shell within the suction pressure region. The compression mechanism is located within the shell, supported on the bearing housing and in communication with the suction pressure region. The suction baffle is located within the suction pressure region and includes a main body located radially between the bearing housing and the suction gas inlet, a first tab extending from a first lateral end of the main body, and a second tab extending from the first lateral end of the main body and spaced axially from the first tab to define a first recess between the first and second tabs. The bearing housing defines a first leg extending within the recess.

20 Claims, 5 Drawing Sheets

COMPRESSOR INCLUDING SUCTION BAFFLE

CROSS-REFERENCE TO RELATED APPLICATIONS

This application claims the benefit of U.S. Provisional Application No. 61/669,793, filed on Jul. 10, 2012. The entire disclosure of the above application is incorporated herein by reference.

FIELD

The present disclosure relates to compressor suction baffle arrangements.

BACKGROUND

A scroll compressor can compress a fluid from a suction pressure to a discharge pressure greater than the suction pressure. The scroll compressor can use a non-orbiting scroll member and an orbiting scroll member, each having a wrap positioned in meshing engagement with one another. The relative movement between the scroll members causes the fluid pressure to increase as the fluid moves from the suction inlet opening to the discharge port.

Generally, such compressors have a suction inlet port provided in an outer shell of the compressor for admitting suction gas into the interior of the shell prior to it entering the suction inlet opening. Because the suction gas being returned to the compressor may often contain lubricant and/or liquid refrigerant which could cause slugging of the compressor, it has been common practice to locate the inlet port in spaced relationship to the suction inlet opening and/or to incorporate baffles in an overlying relationship to such inlet ports to reduce the possibility of such liquid being ingested into the compressor.

SUMMARY

A compressor may include a shell, a bearing housing, a compression mechanism and a suction baffle. The shell may define a suction pressure region and a suction gas inlet in communication with the suction pressure region. The bearing housing may be fixed relative to the shell within the suction pressure region. The compression mechanism may be located within the shell, supported on the bearing housing and in communication with the suction pressure region. The suction baffle may be located within the suction pressure region and may include a main body located radially between the bearing housing and the suction gas inlet, a first tab extending from a first lateral end of the main body, and a second tab extending from the first lateral end of the main body and spaced axially from the first tab to define a first recess between the first and second tabs. The bearing housing may define a first leg extending within the recess that secures the suction baffle axially relative to the bearing housing.

The suction baffle may be retained radially between an outer surface of the bearing housing and an inner surface of the shell. The suction baffle may be free from direct fixation to the shell. The suction baffle may abut the inner surface of the shell.

The suction baffle may include third and fourth tabs extending from a second lateral end of the main body opposite the first lateral end. The fourth tab may be spaced axially from the third tab to define a second recess between the third and fourth tabs. The bearing housing may define a second leg extending within the second recess and securing the suction baffle axially relative to the bearing housing. A circumferential extent of the second tab may overlap the first leg and a circumferential extent of the fourth tab may overlap the second leg when the suction baffle is in a free state. The suction baffle may be configured to provide deflection of the second and fourth tabs inward toward one another during assembly to allow the second and fourth tabs to be displaced past the first and second legs of the bearing housing and locate the first leg within the first recess and the second leg within the second recess.

The main body of the suction baffle may include a central region extending over the suction gas inlet and the first lateral end may include a first region extending at a first angle between 90 and 120 degrees from the central region, a second region extending at a second angle between 90 and 120 degrees from the first region and a third region extending at a third angle between 90 and 130 degrees from the second region with the first and second tabs extending from the third region. The second tab may define a first edge forming an outermost axial end of the second tab and the fourth tab may define a second edge forming an outermost axial end of the fourth tab. The first and second edges may each extend at an angle greater than 90 degrees and less than 180 degrees relative to a longitudinal axis of the suction baffle. The longitudinal axis of the suction baffle may be generally parallel to a longitudinal axis of the compressor.

A compressor suction baffle may include a main body configured to be located radially between a compressor bearing housing and a suction gas inlet in a compressor shell, a first tab extending from a first lateral end of the main body, and a second tab extending from the first lateral end of the main body and spaced axially from the first tab to define a first recess between the first and second tabs. The first recess may be configured to receive a first leg of the bearing housing to secure the suction baffle axially relative to the bearing housing.

The third and fourth tabs may extend from a second lateral end of the main body opposite the first lateral end. The fourth tab may be spaced axially from the third tab to define a second recess between the third and fourth tabs. The second recess may be configured to receive a second leg of the bearing housing to secure the suction baffle axially relative to the bearing housing. A circumferential extent of the second tab is configured to overlap the first leg of the bearing housing and a circumferential extent of the fourth tab is configured to overlap the second leg of the bearing housing when the suction baffle is in a free state. The suction baffle may be configured to provide deflection of the second and fourth tabs inward toward one another during assembly to allow the second and fourth tabs to be displaced past the first and second legs of the bearing housing and locate the first leg within the first recess and the second leg within the second recess. The main body of the suction baffle may include a central region configured to extend over the suction gas inlet and the first lateral end may include a first region extending at a first angle between 90 and 120 degrees from the central region, a second region extending at a second angle between 90 and 120 degrees from the first region and a third region extending at a third angle between 90 and 130 degrees from the second region with the first and second tabs extending from the third region. The second tab may define a first edge forming an outermost axial end of the second tab and the fourth tab may define a second edge forming an outermost axial end of the fourth tab. The first and second edges may each extend at an angle greater than 90 degrees and less than 180 degrees relative to a longitudinal axis of the suction baffle.

An assembly method may include securing a bearing housing within a compressor shell. The bearing housing may include a first leg engaged with the shell. A suction baffle may be placed within the compressor shell adjacent to the first leg of the bearing housing. The suction baffle may include a main body, a first tab extending from a first lateral end of the main body and a second tab extending from the first lateral end of the main body and spaced axially from the first tab to define a first recess between the first and second tabs. The suction baffle may be displaced toward the bearing housing. The second tab may engage the first leg during the displacing and the displacing may force the second tab inward toward a second lateral end of the suction baffle and away from the first leg of the bearing housing to locate the first leg of the bearing housing within the first recess and secure the suction baffle axially relative to the bearing housing.

The suction baffle may be displaced into engagement with the bearing housing after the bearing housing is secured to the shell. The main body of the suction baffle may be located radially between the bearing housing and a suction gas inlet defined in the shell after the displacing. The suction baffle may be retained radially between an outer surface of the bearing housing and an inner surface of the shell after the displacing. The suction baffle may be free from direct fixation to the shell after the displacing. The suction baffle may abut the inner surface of the shell after the displacing.

The suction baffle may include third and fourth tabs extending from a second lateral end of the main body opposite the first lateral end. The fourth tab may be spaced axially from the third tab to define a second recess between the third and fourth tabs. The bearing housing may define a second leg extending within the second recess and securing the suction baffle axially relative to the bearing housing. A circumferential extent of the second tab may overlap the first leg and a circumferential extent of the fourth tab may overlap the second leg before and after the displacing when suction baffle is in a free state. The second and fourth tabs may be deflected inward toward one another during the displacing to allow the second and fourth tabs to pass the first and second legs of the bearing housing and locate the first leg within the first recess and the second leg within the second recess. The main body of the suction baffle may include a central region extending over a suction gas inlet defined in the shell after the displacing and the first lateral end may include a first region extending at a first angle between 90 and 120 degrees from the central region, a second region extending at a second angle between 90 and 120 degrees from the first region and a third region extending at a third angle between 90 and 130 degrees from the second region with the first and second tabs extending from the third region. The second tab may define a first edge forming an outermost axial end of the second tab and the fourth tab may define a second edge forming an outermost axial end of the fourth tab. The first and second edges may each extend at an angle greater than 90 degrees and less than 180 degrees relative to a longitudinal axis of the compressor and the displacing may includ the suction baffle being displaced along the longitudinal axis of the compressor.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The present teachings are suitable for incorporation in many different types of scroll and rotary compressors, including hermetic machines, open-drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Figure 1:
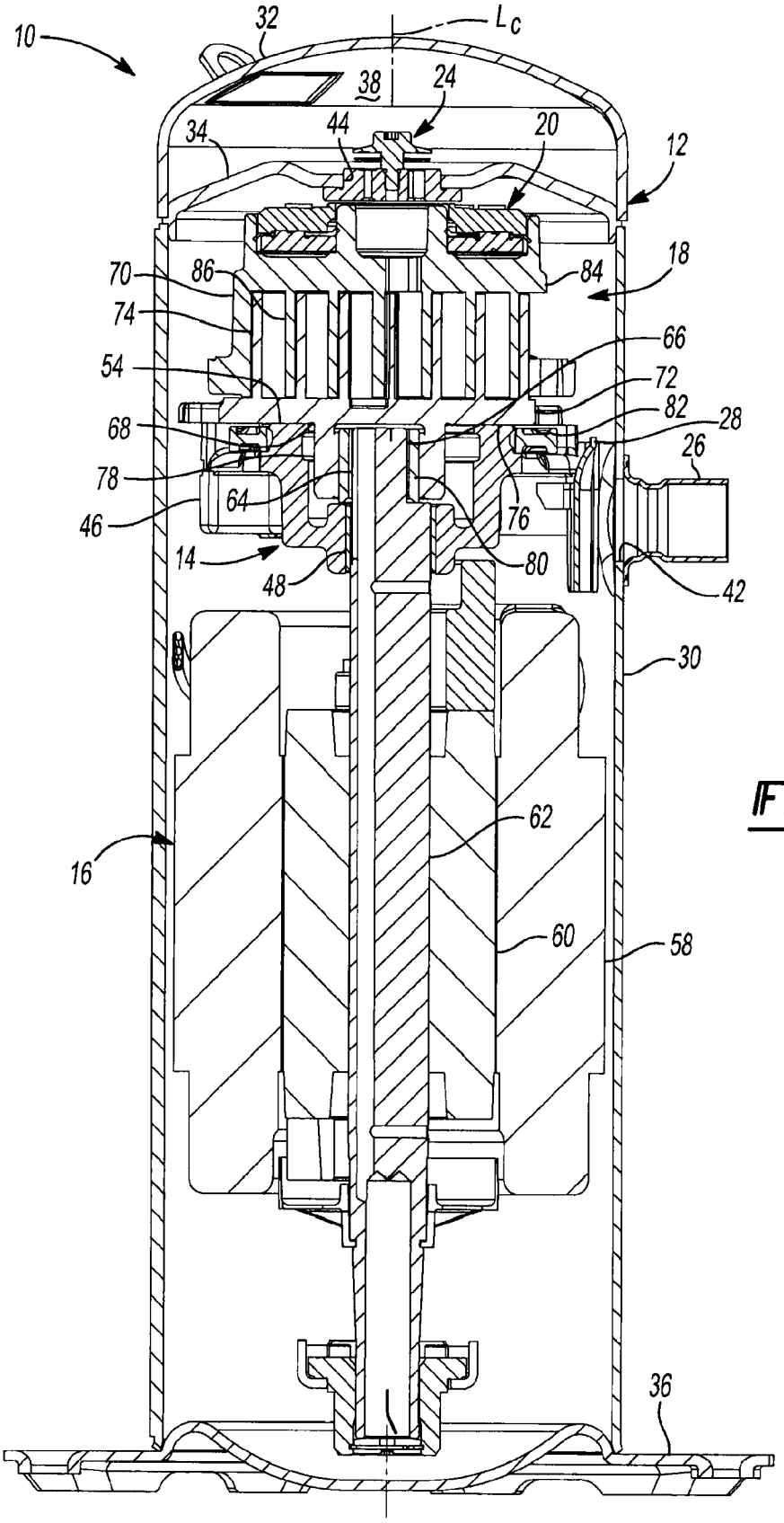
FIG. 1 is a section view of a compressor assembly according to the present disclosure.

With reference to FIG. 1, the compressor 10 may include a hermetic shell assembly 12, a bearing housing assembly 14, a motor assembly 16, a compression mechanism 18, a seal assembly 20, a refrigerant discharge fitting (not shown), a discharge valve assembly 24, a suction gas inlet fitting 26, and a suction baffle 28. The shell assembly 12 may house the bearing housing assembly 14, the motor assembly 16, the compression mechanism 18, and the suction baffle 28.

The shell assembly 12 may form a compressor housing and may include a cylindrical shell 30, an end cap 32 at the upper end thereof, a transversely extending partition 34, and a base 36 at a lower end thereof. The end cap 32 and the partition 34 may define a discharge chamber 38. The discharge chamber 38 may form a discharge muffler for the compressor 10. The refrigerant discharge fitting may be attached to the shell assembly 12 at an opening (not shown) in the end cap 32. The suction gas inlet fitting 26 may be attached to the shell assembly 12 at the suction gas inlet 42. The partition 34 may include a discharge passage 44 therethrough providing communication between the compression mechanism 18 and the discharge chamber 38. The discharge valve assembly 24 may be located on the partition 34 at the discharge passage 44 and may generally prevent a reverse flow condition.

The bearing housing assembly 14 may be affixed to the shell 30 at a plurality of points in any desirable manner, such as staking. The bearing housing assembly 14 may include a bearing housing 46 and a bearing 48. With additional reference to FIG. 2, the bearing housing 46 may house the bearing 48 therein and may define a series of radially extending legs 52 and an annular flat thrust bearing surface 54 on an axial end surface thereof. The bearing housing 46 may include apertures 56 extending through the legs 52 and receiving fasteners (not shown).

The motor assembly 16 may generally include a motor stator 58, a rotor 60, and a drive shaft 62. The motor stator 58 may be press fit into shell 30. The drive shaft 62 may be rotatably driven by the rotor 60 and may be rotatably supported within the bearing housing assembly 14. The rotor 60 may be press fit on the drive shaft 62. The drive shaft 62 may include an eccentric crank pin 64 having a flat 66 thereon.

The compression mechanism 18 may generally include an orbiting scroll 68 and a non-orbiting scroll 70. The orbiting scroll 68 may include an end plate 72 having a spiral vane or wrap 74 on the upper surface thereof and an annular flat thrust surface 76 on the lower surface. The thrust surface 76 may interface with the annular flat thrust bearing surface 54 on the main bearing housing 46. A cylindrical hub 78 may project downwardly from the thrust surface 76 and may have a drive bushing 80 rotatably disposed therein. The drive bushing 80 may include an inner bore in which the crank pin 64 is drivingly disposed. The crank pin flat 66 may drivingly engage a flat surface in a portion of the inner bore of the drive bushing 80 to provide a radially compliant driving arrangement. An Oldham coupling 82 may be engaged with the orbiting and non-orbiting scrolls 68, 70 to prevent relative rotation therebetween. The non-orbiting scroll 70 may include an end plate 84 having a spiral wrap 86 on a lower surface thereof, and a series of radially outward extending flange portions (not shown) defining openings receiving fasteners.

Figure 2:
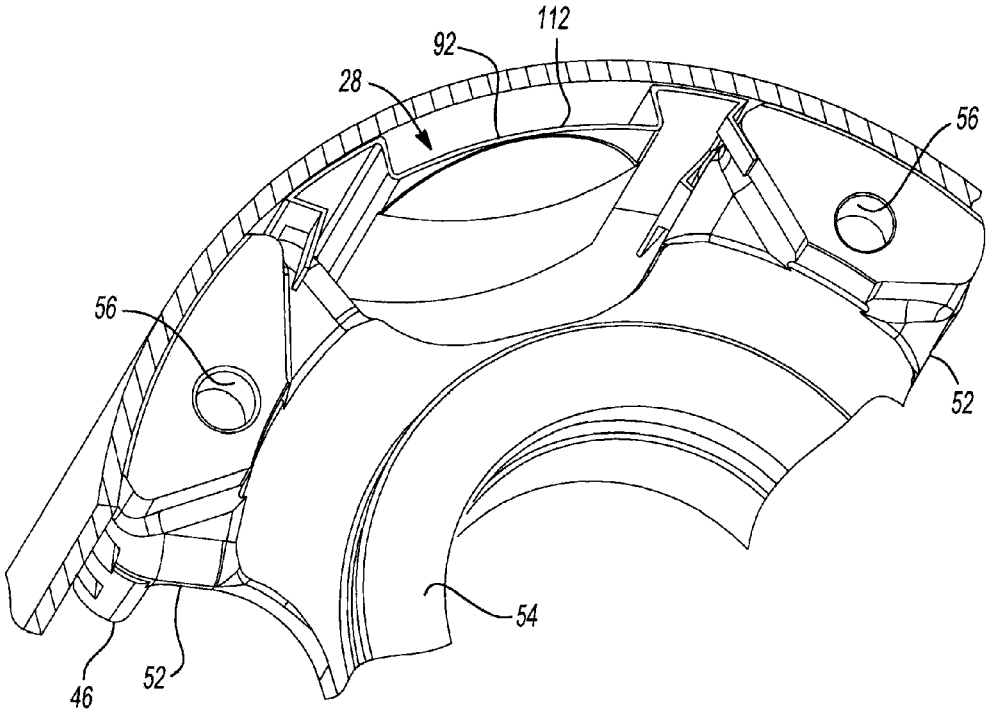
FIG. 2 is a fragmentary perspective view of the compressor assembly shown in FIG. 1.
Figure 4:
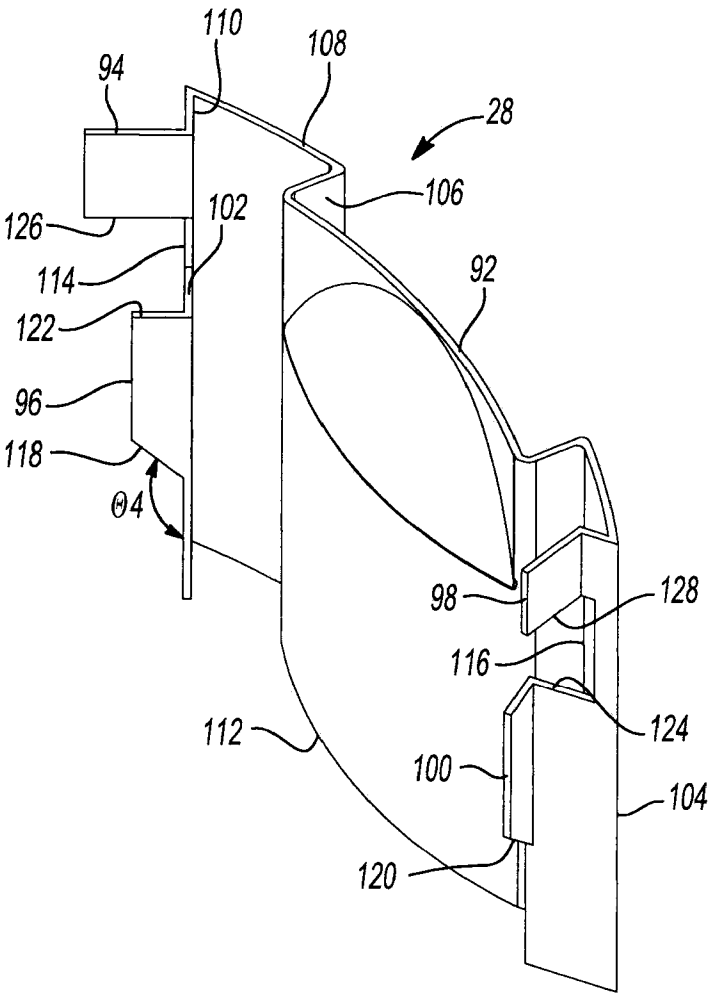
FIG. 4 is an additional perspective view of the suction baffle shown in FIG. 3.
Figure 3:
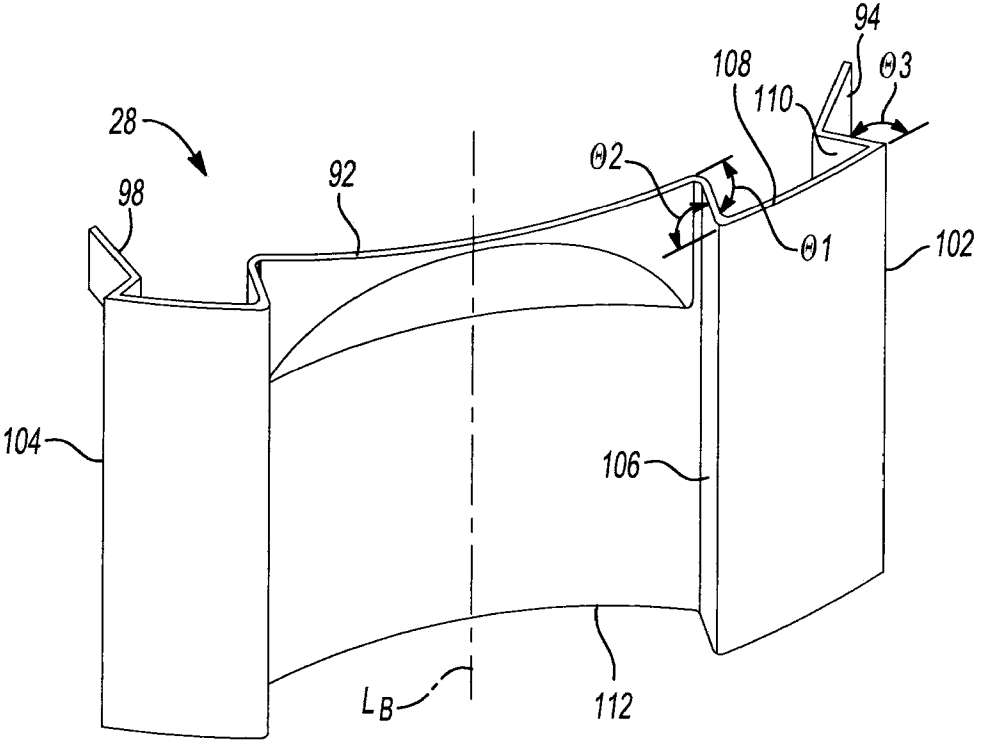
FIG. 3 is a perspective view of the suction baffle shown in FIGS. 1 and 2.

The suction baffle 28 may be located within a suction pressure region of the shell assembly 12 and may overlie the suction gas inlet 42 to direct suction gas entering the compressor 10 in a downward direction toward the motor assembly 16. With reference to FIGS. 2-4, the suction baffle 28 may include a main body 92 and tabs 94, 96, 98, 100. The main body 92 may extend between the suction gas inlet 42 and the bearing housing 46 with the first and second tabs 94, 96 extending from a first lateral end 102 of the main body 92 and the third and fourth tabs 98, 100 extending from a second lateral end 104 of the main body 92. The first lateral end 102 of the main body and the first and second tabs 94, 96 may be generally similar to the second lateral end 104 of the main body 92 and the third and fourth tabs 98, 100. For simplicity, the first lateral end 102 of the main body 92 and the first and second tabs 94, 96 will be described with the understanding that the description applies equally to the second lateral end 104 of the main body 92 and the third and fourth tabs 98, 100.

The first lateral end 102 may form a flexible arm having first, second and third regions 106, 108, 110. The first region 106 may extend toward the shell 30 at a first angle (θ1) from a central region 112 of the suction baffle 28. The central region 112 may be offset from the shell 30 and the suction gas inlet 42 and the first angle (θ1) may be greater than ninety degrees, and more specifically between ninety degrees and one hundred twenty degrees. The second region 108 may extend from the first region 106 at a second angle (θ2) of greater than ninety degrees, and more specifically between ninety degrees and one hundred twenty degrees. More specifically, the second region 108 may define a curved body abutting and generally following the contour of the inner surface of the shell 30.

In addition, the first and second angles (θ1, θ2) may be within ten degrees of one another. More specifically, the first angle (θ1) may be generally equal to the second angle (θ2). The third region 110 may extend from the second region 108 and away from shell toward the bearing housing 46 at a third angle (θ3) of greater than ninety degrees, and more specifically between ninety degrees and one hundred thirty degrees. The first and second tabs 94, 96 may extend from the third region 110 and define a first recess 114 longitudinally between the first and second tabs 94, 96.

As seen in FIG. 2, a first leg 52 of the bearing housing 46 may extend within the first recess 114 formed between the first and second tabs 94, 96 and a second leg 52 of bearing housing 46 may extend within a second recess 116 formed between the third and fourth tabs 98, 100, securing the suction baffle 28 longitudinally relative to bearing housing 46 within the shell 30. The second and fourth tabs 96, 100 may each include tapered leading edges 118, 120, respectively, to facilitate installation of the suction baffle 28. More specifically, the tapered leading edge 118 may be defined on an opposite side of the second tab 96 from an edge 122 defining the first recess 114 and may form an outermost axial end of the second tab 96. Similarly, the tapered leading edge 120 may be defined on an opposite side of the fourth tab 100 from an edge 124 defining the second recess 116 and may form an outermost axial end of the fourth tab 100. The tapered leading edges 118, 120 may each extend at a fourth angle (θ4) greater than ninety degrees and less than one hundred eighty degrees relative to a longitudinal axis ($L_B$) of the suction baffle 28. More specifically, the fourth angle (θ4) may be between one hundred degrees and one hundred forty-five degrees.

The longitudinal axis ($L_B$) of the suction baffle 28 may be generally parallel to the longitudinal axis ($L_C$) of the compressor 10 (FIG. 1). The edges 122, 124 of the second and fourth tabs 96, 100 and corresponding edges 126, 128 of the first and third tabs 94, 98 defining the first and second recesses 114, 116 may each extend generally perpendicular to the longitudinal axis ($L_B$) of the suction baffle 28 to secure the suction baffle 28 to the bearing housing 46 after installation.

Figure 5:
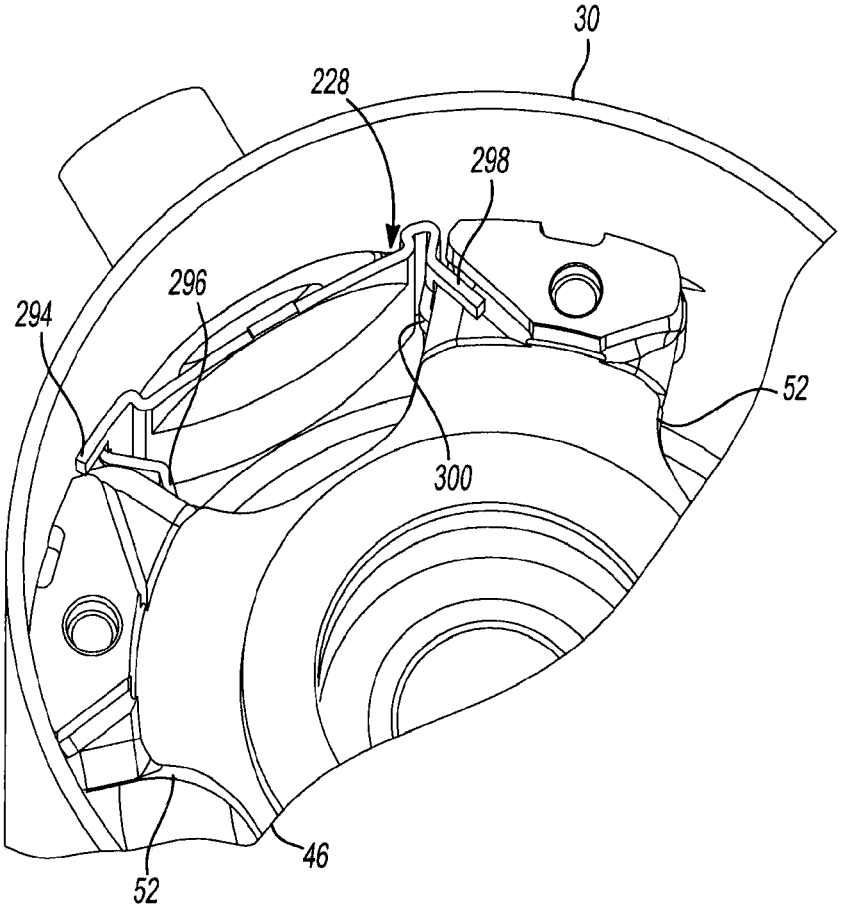
FIG. 5 is a fragmentary perspective view of the compressor assembly shown in FIG. 1 with an alternate suction baffle.
Figure 6:
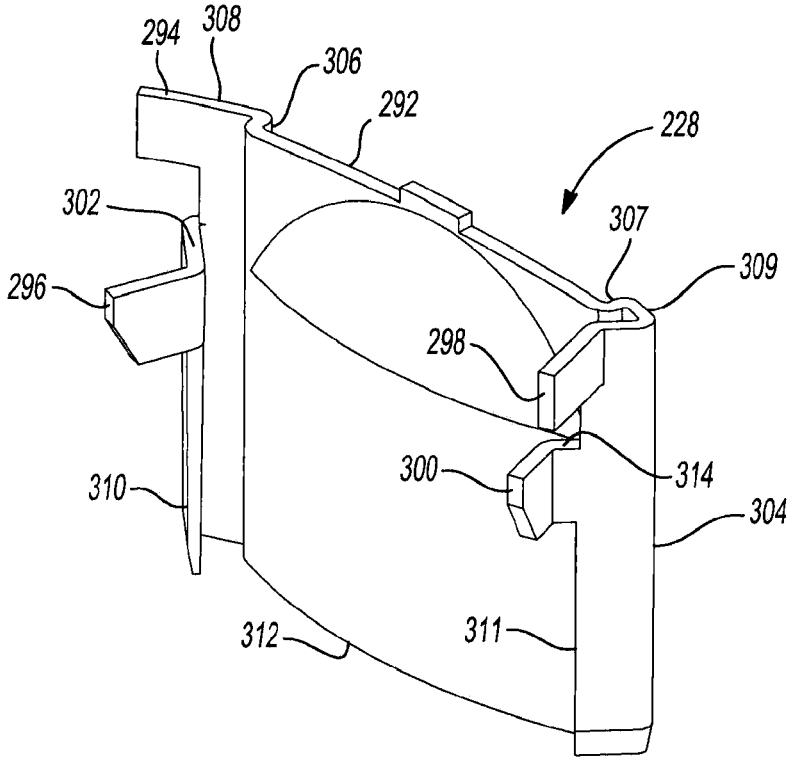
FIG. 6 is a perspective view of the suction baffle from FIG. 5.
Figure 7:
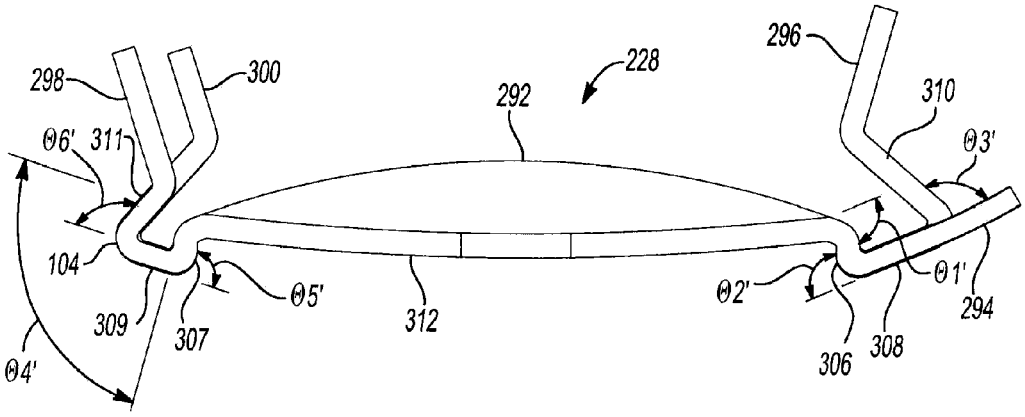
FIG. 7 is an end view of the suction baffle shown in FIG. 6.

In an alternate arrangement seen in FIGS. 5-7, a suction baffle 228 may be incorporated into the compressor 10 in place of the suction baffle 28. The suction baffle 228 may be similar to the suction baffle 28, with the exceptions noted below. As seen in FIGS. 5-7, the main difference between the suction baffle 28 and the suction baffle 228 is the orientation of the first and second lateral ends 302, 304.

The first lateral end 302 of the main body 292 may form a flexible arm having first, second and third regions 306, 308, 310. The first region 306 may extend toward the shell 30 at a first angle (θ1') from a central region 312 of the suction baffle 228. The central region 312 may be offset from the shell 30 and the suction gas inlet 42 and the first angle (θ1') may be greater than ninety degrees, and more specifically between ninety degrees and one hundred twenty degrees. The second region 308 may extend from the first region 306 at a second angle (θ2') of greater than ninety degrees, and more specifically between ninety degrees and one hundred twenty degrees. More specifically, the second region 308 may define a curved body abutting and generally following the contour of the inner surface of the shell 30.

In addition, the first and second angles (θ1', θ2') may be within ten degrees of one another. More specifically, the first angle (θ1') may be generally equal to the second angle (θ2'). The third region 310 may extend from the second region 308 and away from shell 30 toward the bearing housing 46 at a third angle (θ3') of greater than ninety degrees, and more specifically between ninety degrees and one hundred thirty degrees. The first tab 294 may extend from the second region 308 and the second tab 296 may extend from the third region 310. The first tab 294 may extend inline with the second region 308 and the second tab 296 may extend inward from the third region 310 relative to the shell 30.

The second lateral end 304 of the main body 292 may form a flexible arm having first, second and third regions 307, 309, 311. The first region 307 may extend toward the shell 30 at a fourth angle (θ4') from the central region 312 of the suction baffle 228. The fourth angle (θ4') may be greater than ninety degrees, and more specifically between ninety degrees and one hundred twenty degrees. The second region 309 may extend from the first region 307 at a fifth angle (θ5') of greater than ninety degrees, and more specifically between ninety degrees and one hundred twenty degrees. More specifically, the second region 309 may define a curved body abutting and generally following the contour of the inner surface of the shell 30.

In addition, the fourth and fifth angles (θ4', θ5') may be within ten degrees of one another. More specifically, the fourth angle (θ4') may be generally equal to the fifth angle (θ5'). The third region 311 may extend from the second region 309 and away from shell 30 toward the bearing housing 46 at a sixth angle (θ6') of greater than ninety degrees, and more specifically between ninety degrees and one hundred thirty degrees. The third and fourth tabs 298, 300 may extend inward from the third region 311 relative to the shell 30 and define a recess 314 longitudinally between the third and fourth tabs 298, 300. The leg 52 of the main bearing housing 46 may be located in the recess 314 to secure the suction baffle 228 within the shell 30.

During assembly of the compressor 10, the bearing housing 46 may be secured to the shell 30. As noted above, the bearing housing 46 may be affixed to the shell 30 at a plurality of points in any desirable manner, such as staking. The suction baffle 28 may be installed after the bearing housing 46 is fixed to the shell 30. Installation of the alternate suction baffle 228 may be similar to the installation of the suction baffle 28. For simplicity, the installation of the suction baffle 228 will not be described in detail with the understanding that the description of the installation of the suction baffle 28 applies equally.

The suction baffle 28 may be snapped into engagement with the bearing housing 46. More specifically, the suction baffle 28 may be placed within the shell 30 with the tapered leading edges 118, 120 each engaged with a leg 52 of the bearing housing 46.

The suction baffle 28 may be displaced in a direction generally parallel to the longitudinal axis ($L_B$) of the suction baffle 28 (and generally parallel to the longitudinal axis ($L_C$) of the compressor 10) until the tapered leading edges 118, 120 are each displaced past the legs 52 of the bearing housing 46 and a first leg 52 is located in the first recess 114 and a second leg 52 is located in the second recess 116. A circumferential extent of the second tab 96 may overlap the first leg 52 and a circumferential extent of the fourth tab 100 may overlap the second leg 52 when suction baffle is in a free state before and after the displacement of the suction baffle. The second and fourth tabs 96, 100 may be deflected inward toward one another during the displacement of the suction baffle 28 due to the engagement between the tapered leading edges 118, 120 of the second and fourth tabs 96, 100 with the first and second legs 52 of the bearing housing 46. The defection of the second and fourth tabs 96, 100 may allow the second and fourth tabs 96, 100 to pass the first and second legs 52 of the bearing housing 46 and locate the first leg 52 within the first recess 114 and the second leg 52 within the second recess 116.

When the legs 52 are located in the first and second recess 114, 116, the suction baffle 28 may be fixed against longitudinal displacement relative to the bearing housing 46. The suction baffle 28 may be secured radially between the bearing housing 46 and the shell 30 after assembly. The assembly process discussed above may provide a non-permanent fixation of the suction baffle 28 relative to the compressor (i.e., removal of suction baffle 28 does not require damage to the shell 30 or bearing housing 46).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell defining a suction pressure region and a suction gas inlet in communication with said suction pressure region;

a bearing housing fixed relative to said shell within said suction pressure region;

a compression mechanism located within said shell, supported on said bearing housing and in communication with said suction pressure region; and a suction baffle located within said suction pressure region and including:

a main body located radially between said bearing housing and said suction gas inlet;

a first tab extending from a first lateral end of said main body; and a second tab extending from said first lateral end of said main body and spaced axially from said first tab to define a first recess between said first and second tabs, said bearing housing defining a first leg extending within said recess and securing said suction baffle axially relative to said bearing housing.

2. The compressor of claim 1, wherein said suction baffle is retained radially between an outer surface of said bearing housing and an inner surface of said shell.

3. The compressor of claim 2, wherein said suction baffle is free from direct fixation to said shell.

4. The compressor of claim 3, wherein said suction baffle abuts said inner surface of said shell.

5. The compressor of claim 1, wherein said suction baffle includes third and fourth tabs extending from a second lateral end of said main body opposite said first lateral end, said fourth tab spaced axially from said third tab to define a second recess between said third and fourth tabs, said bearing housing defining a second leg extending within said second recess and securing said suction baffle axially relative to said bearing housing.

6. The compressor of claim 5, wherein a circumferential extent of said second tab overlaps said first leg and a circumferential extent of said fourth tab overlaps said second leg when said suction baffle is in a free state, said suction baffle being configured to provide deflection of said second and fourth tabs inward toward one another during assembly to allow said second and fourth tabs to be displaced past said first and second legs of said bearing housing and locate said first leg within said first recess and said second leg within said second recess.

7. The compressor of claim 6, wherein said main body of said suction baffle includes a central region extending over said suction gas inlet and said first lateral end includes a first region extending at a first angle between 90 and 120 degrees from said central region, a second region extending at a second angle between 90 and 120 degrees from said first region and a third region extending at a third angle between 90 and 130 degrees from said second region with said first and second tabs extending from said third region.

8. The compressor of claim 6, wherein said second tab defines a first edge forming an outermost axial end of said second tab and said fourth tab defines a second edge forming an outermost axial end of said fourth tab, said first and second edges each extending at an angle greater than 90 degrees and less than 180 degrees relative to a longitudinal axis of said suction baffle.

9. The compressor of claim 8, wherein the longitudinal axis of said suction baffle is generally parallel to a longitudinal axis of the compressor.

10. A compressor suction baffle comprising:

a main body configured to be located radially between a compressor bearing housing and a suction gas inlet in a compressor shell;

a first tab extending from a first lateral end of said main body; and a second tab extending from said first lateral end of said main body and spaced axially from said first tab to define a first recess between said first and second tabs, said first recess configured to receive a first leg of the bearing housing to secure the suction baffle axially relative to the bearing housing.

11. The suction baffle of claim 10, further comprising third and fourth tabs extending from a second lateral end of said main body opposite said first lateral end, said fourth tab spaced axially from said third tab to define a second recess between said third and fourth tabs, said second recess configured to receive a second leg of the bearing housing to secure the suction baffle axially relative to the bearing housing.

12. The suction baffle of claim 11, wherein a circumferential extent of said second tab is configured to overlap the first leg of the bearing housing and a circumferential extent of said fourth tab is configured to overlap the second leg of the bearing housing when the suction baffle is in a free state, the suction baffle being configured to provide deflection of said second and fourth tabs inward toward one another during assembly to allow said second and fourth tabs to be displaced past the first and second legs of the bearing housing and locate the first leg within said first recess and the second leg within said second recess.

13. The suction baffle of claim 12, wherein said main body of the suction baffle includes a central region configured to extend over the suction gas inlet and said first lateral end includes a first region extending at a first angle between 90 and 120 degrees from said central region, a second region extending at a second angle between 90 and 120 degrees from said first region and a third region extending at a third angle between 90 and 130 degrees from said second region with said first and second tabs extending from said third region.

14. The suction baffle of claim 12, wherein said second tab defines a first edge forming an outermost axial end of said second tab and said fourth tab defines a second edge forming an outermost axial end of said fourth tab, said first and second edges each extending at an angle greater than 90 degrees and less than 180 degrees relative to a longitudinal axis of said suction baffle.

15. A method comprising:

securing a bearing housing within a compressor shell, the bearing housing including a first leg engaged with the shell;

placing a suction baffle within the compressor shell adjacent to the first leg of the bearing housing, the suction baffle including a main body, a first tab extending from a first lateral end of the main body and a second tab extending from the first lateral end of said main body and spaced axially from the first tab to define a first recess between the first and second tabs; and displacing the suction baffle toward the bearing housing, the second tab engaging the first leg during the displacing and the displacing forcing the second tab inward toward a second lateral end of the suction baffle and away from the first leg of the bearing housing to locate the first leg of the bearing housing within the first recess and secure the suction baffle axially relative to the bearing housing.

16. The method of claim 15, wherein the suction baffle is displaced into engagement with the bearing housing after the bearing housing is secured to the shell.

17. The method of claim 16, wherein the main body of the suction baffle is located radially between the bearing housing and a suction gas inlet defined in the shell after the displacing.

18. The method of claim 17, wherein the suction baffle is free from direct fixation to the shell after said displacing.

19. The method of claim 15, wherein the suction baffle includes third and fourth tabs extending from a second lateral end of the main body opposite the first lateral end, the fourth tab spaced axially from the third tab to define a second recess between the third and fourth tabs, the bearing housing defining a second leg extending within the second recess and securing the suction baffle axially relative to the bearing housing.

20. The method of claim 19, wherein a circumferential extent of the second tab overlaps the first leg and a circumferential extent of the fourth tab overlaps the second leg before and after the displacing when suction baffle is in a free state, the second and fourth tabs being deflected inward toward one another during the displacing to allow the second and fourth tabs to pass the first and second legs of the bearing housing and locate the first leg within the first recess and the second leg within the second recess.

* * * * *